US005451060A

United States Patent [19]

Dalbo

[11] Patent Number: 5,451,060

[45] Date of Patent: Sep. 19, 1995

[54] STROKE ENHANCING HARNESS

[75] Inventor: Leo Dalbo, Sebatopol, Calif.

[73] Assignee: Dalme, Inc., Bloomfield Hills, Mich.

[21] Appl. No.: 166,159

[22] Filed: Dec. 10, 1993

Related U.S. Application Data

[63] Continuation-in-part of Ser. No. 967,776, Oct. 28, 1992, abandoned.

[51] Int. Cl.[6] ..... A63B 69/36

[52] U.S. Cl. ..... 273/189 R; 2/115

[58] Field of Search ..... 273/189 R, 187.2, 188 R; 2/115

[56] References Cited

U.S. PATENT DOCUMENTS

| | | | |
|---|---|---|---|
| 2,564,564 | 8/1951 | Cookman | 273/189 R |
| 3,188,090 | 6/1965 | Job | 273/189 R |
| 3,679,214 | 7/1972 | Boyte | 273/189 R |
| 3,740,052 | 6/1973 | Arkin | 273/189 R |
| 4,895,373 | 1/1990 | Richman | 273/189 R |
| 5,154,416 | 10/1992 | Smull | 273/189 R X |
| 5,203,570 | 4/1993 | Graham | 273/189 R X |
| 5,257,779 | 11/1993 | Dalbo | 273/189 R X |

*Primary Examiner*—George J. Marlo

*Attorney, Agent, or Firm*—Reising, Ethington, Barnardy & Perry

[57] ABSTRACT

Four embodiments of a sport swing harness (10, 10',10'',10''') are disclosed. The sport swing harness (10,10',10'',10''') is fabricated from a flexible, inelastic material. The harness (10,10',10'',10''') includes at least one loop (16,16',16'',16''') which extends around at least one shoulder of a trainee (14). A strap (18) of the same flexible inelastic material snaps over the back and under the second shoulder of the trainee (14). The end (22) of the strap (18) is held by the trainee (14) in his or her leading hand (24). The third alternative embodiment (10''') incorporates the harness (10''') into a sporting garment (32), such as a sweater, coat, vest or shirt.

4 Claims, 4 Drawing Sheets

STROKE ENHANCING HARNESS

This application is a continuation-in-part of application Ser. No. 07/967,776, filed Oct. 28, 1992, now abandoned.

BACKGROUND OF THE INVENTION

1. Technical Field

The subject invention relates to golf and tennis practice devices. More particularly, the subject invention relates to golf and tennis practice devices which contact the body of the player.

2. Description of Related Art

Various golf and tennis swing devices have been employed throughout the years to help golfers and tennis players ("trainess") improve their swings. None of these devices, however, help trainees perfect a consistent swing throughout the total swing, from the back swing to the follow-through.

U.S. Pat. No. 2,022,910, issued to Hanley on Dec. 3, 1935, discloses a golf training device which comprises a loop to be secured around the arm just above the elbow and a strap connected to the loop which extends down to a glove to be worn by the golfer. The loop and the strap are made of an elastic material which is deformed by the golfer as the golfer completes his swing. Although this golf training device persuades the golfer to cock his wrists at the correct point of the backswing, this golf training device does not provide total restraint throughout the whole golf swing as is required when training a golfer how to swing.

U.S. Pat. No. 1,962,256, issued to Nelson et al. on Jan. 30, 1933, discloses a training device for golfers wherein a portion of the device includes a loop which is wrapped around the leading shoulder of the golfer and a strap which is wrapped over the remaining shoulder and secured to a glove worn by the trailing hand of the golf swing. Again, this loop and strap are made of elastic material, preventing the device from providing a total restraint throughout the whole golf swing. In addition, this partial restraining loop/strap combination restrains the trailing or back hand of the golfer, as opposed to the front or forehand, and, thus, diminishes the effects of the training device because the trailing hand of the golfer, i.e., the right hand for a right-handed golfer, follows the motion of the leading hand and not the opposite.

U.S. Pat. No. 4,134,589, issued to Arena on Jan. 6, 1979, discloses a golf swing training device which includes a loop of material which is secured between the midsection of the golfer, the ground, the back of the golfer and the forehand of the golfer in a loop-like configuration. This training device correctly restrains the forehand of the golfer. This device, however, is severely limited in its use because it must be secured to the ground. This device cannot be used for other sports, i.e., tennis, nor can it be used on the golf course because you must secure the device to the ground before each swing. Another problem associated with this device is that the straps tend to obstruct the golf swing because the anchor which secures the loop to the ground must be secured to the ground in close proximity to the location of the golf ball.

SUMMARY OF THE INVENTION AND ADVANTAGES

The subject invention is a sport swing harness and is used with a sport swinging implement for increasing the consistency of a sport swing of a trainee. The sport swing harness comprises a loop of flexible elastic material and a strap comprising a length of flexible inelastic material having first and second ends. The first end of the strap of the flexible inelastic material is fixedly secured to the loop. The loop receives a first shoulder of a trainee therethrough and the strap extends over the back and underneath a second shoulder of the trainee. The second end of the strap is held by the trainee with a handle of a sport swinging implement as the sport swinging implement is rotated through a swing. The flexible inelastic material of the strap provides a total restraint of the swing.

The advantages associated with the sport swing harness include providing total restraint of a swing throughout the complete swing, the ability to use the sport swing harness in practice as well as during a competition, and the ability to use the sport swing harness in both golf and tennis.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
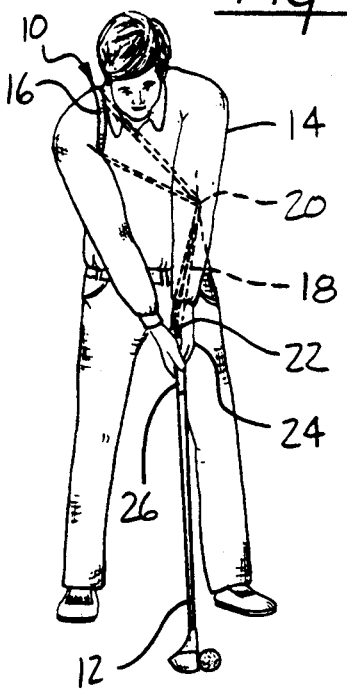
FIG. 1 is a front view of a trainee addressing a golf ball using the preferred embodiment of the subject invention.
Figure 2:
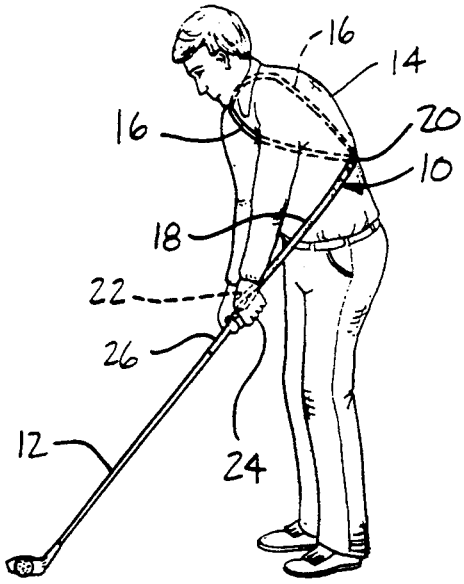
FIG. 2 is a side view of a trainee addressing a golf ball using the preferred embodiment of the subject invention.
Figure 3:
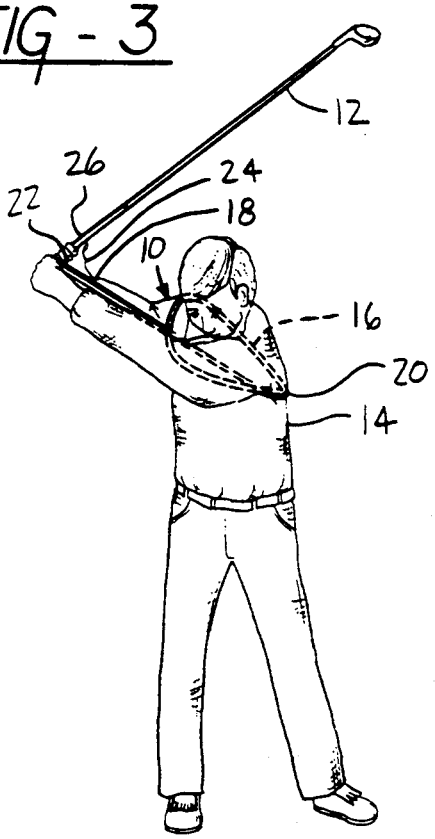
FIG. 3 is a front view of a trainee back-swinging using the preferred embodiment of the subject invention.
Figure 4:
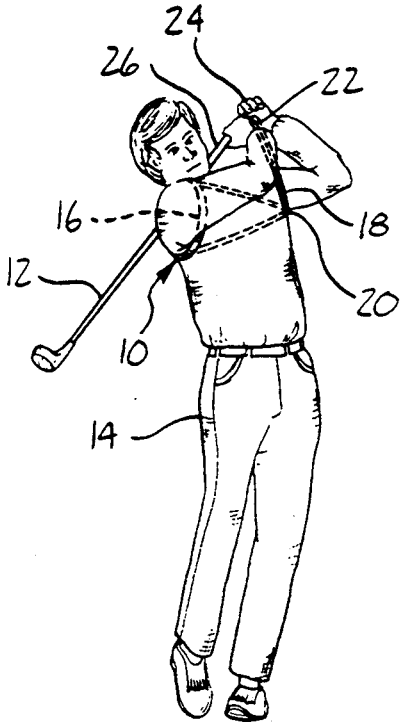
FIG. 4 is a side view of a trainee following through using the preferred embodiment of the subject invention.

Because there are four embodiments shown in the Figures, primed-like numerals will be representing similar structure and all of the four embodiments. Also, descriptions of the similar structures will not be repeated once described.

Turning to FIGS. 1 through 4, the subject sport swing harness is generally indicated at 10. The sport swing harness is used with a sport swinging implement 12. Although the trainee 14 is shown using a golf club as a sport swing implement 12, it is noted that the sport swing implement 12 could be a tennis racket as is shown in the Figures corresponding to the alternative embodiments, discussed below.

The sport swing harness 10 comprises a closed loop 16 of flexible inelastic material. The loop 16 is adjustable through a buckle (not shown) or any other such device well known in the art used to adjust the length of a loop of material. The loop 16 should be of sufficient length to receive the trailing arm of the trainee 14 therethrough and rest around the shoulder of the trainee 14 so as not to limit the freedom of movement of the arm.

Attached to the loop 16 is a strap 18 of flexible inelastic material. The strap 18 includes a first end 20 and a second end 22. Again, the strap 18 may be adjusted via any device well known in the art, i.e., buckles, buttons, snaps, and the like (none shown). In the preferred embodiment of the subject invention, the strap 18 is actually a loop or, said another way, a length of material doubled over and aligned so, in effect, provide a single strap its opposed ends terminating at the first end 20 and the second end 22.

Figure 12:
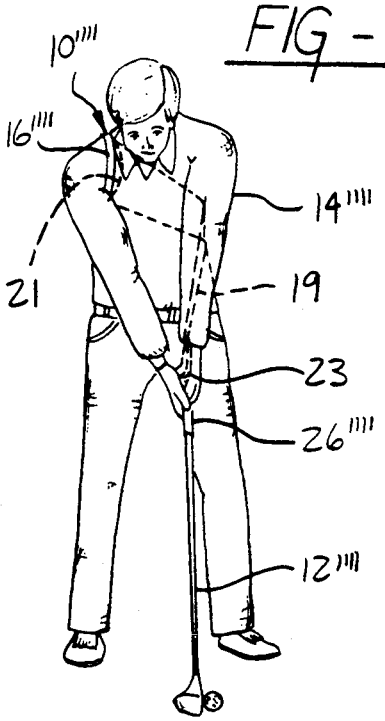
FIGS. 12–15 are views of a trainee addressing a golf ball using a fourth alternative embodiment of the subject invention.
Figure 13:
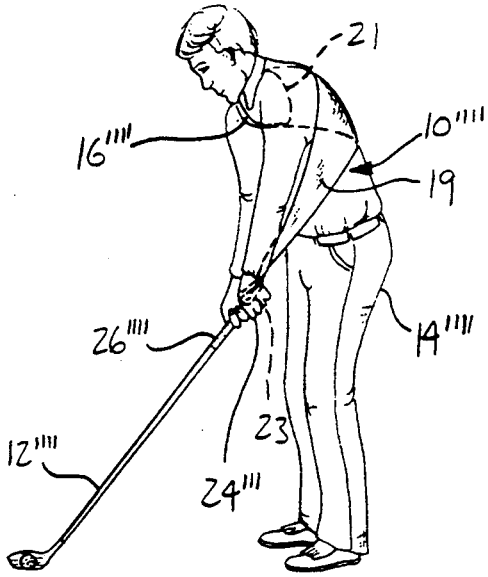
Figure 14:
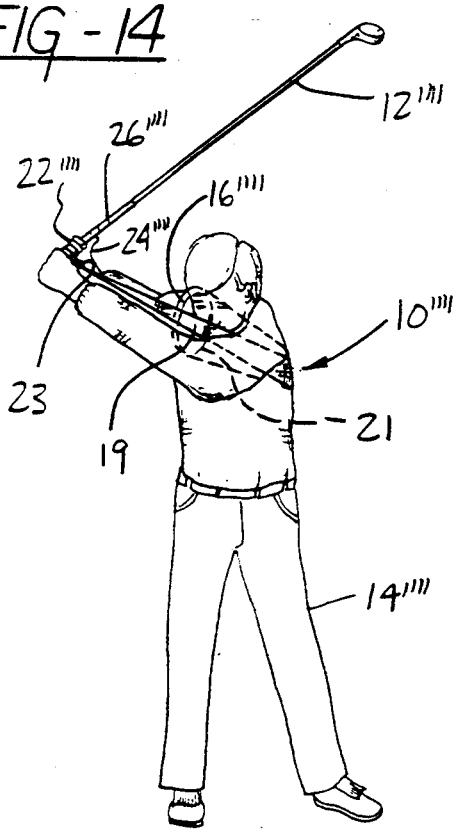
Figure 15:
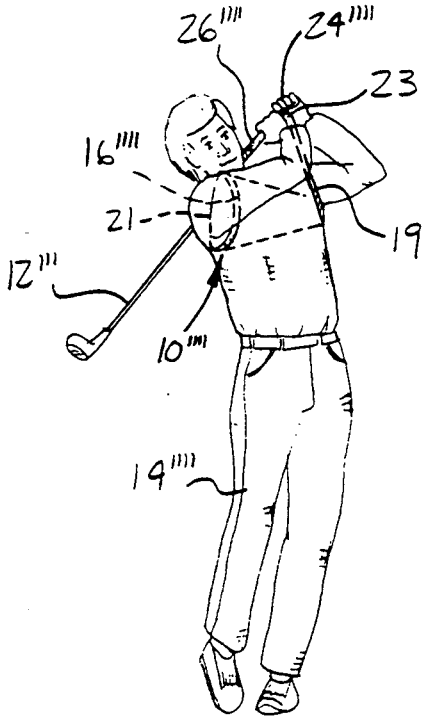

As may be seen in FIGS. 12–14 the strap 18'''' is fabricated of a flexible inelastic material and includes a generally triangular face 19. The pseudo-base 21 of the triangular face 19 is curved so it can be attached to the loop 16''''. The triangular face 19 then is wrapped around the torso of the trainee 14'''' and extended to the hands of the trainee 14'''' where the triangular face 19 has narrowed to a thin section. A strap 23 may be attached to the second end 22'''' of the triangular face 19 to eliminate any discomfort in holding the training device 10''''.

The triangular face 19 is used to align the torso of the trainee 14''''. More specifically, where the bottom edge of the triangular face 19 is directly below the top edge, removing the triangular face 19 from the view of the trainee 14, the trainee 14'''' is properly aligned to swing at the ball.

The first end 20 is fixedly secured to the loop 16. The strap 18 then extends over the back and underneath the second shoulder of the trainee 14. The second end 22 can be looped over the leading hand 24 and thereby held by the trainee 14 in the leading hand 24 of the trainee 14. Therefore, the strap 18 of flexible inelastic material extends over the upper back and underneath the arm pit and shoulder of the leading hand 24 and down to the leading hand 24. Because the trainee 14 extends his or her leading hand 24, the strap 18 will restrict the tendency of the trainee 14 to extend beyond a point of swinging efficiency and maintain a swing in posture which facilitates an efficient, smooth and strong stroke utilizing the proper muscles developed to make such a movement.

The trainee 14 will also hold the handle 26 of the sport swinging implement 12, either the golf club or the tennis racket, as the sport swinging implement 12 is rotated through a complete swing. The sport swing harness 10 limits the backswing by restricting the leading hand 24 from moving to a position which is inefficient. As the trainee 14 begins his or her downswing, the sport swing harness 10 allows the trainee 14 to extend only to a certain extent, i.e., the radius of a circle defined by the length 18 from underneath the shoulder of the leading hand 24 to the leading hand 24 and then to the sport swinging implement 12. In addition, the follow-through of the swing is limited in motion due to the same radius as defined above.

Figure 5:
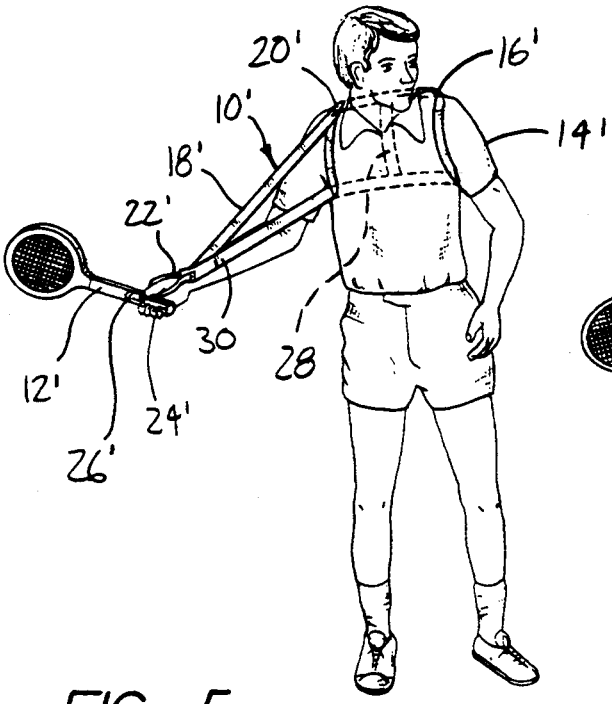
FIGS. 5–7 are views of a trainee using the first alternative embodiment of the subject invention.
Figure 6:
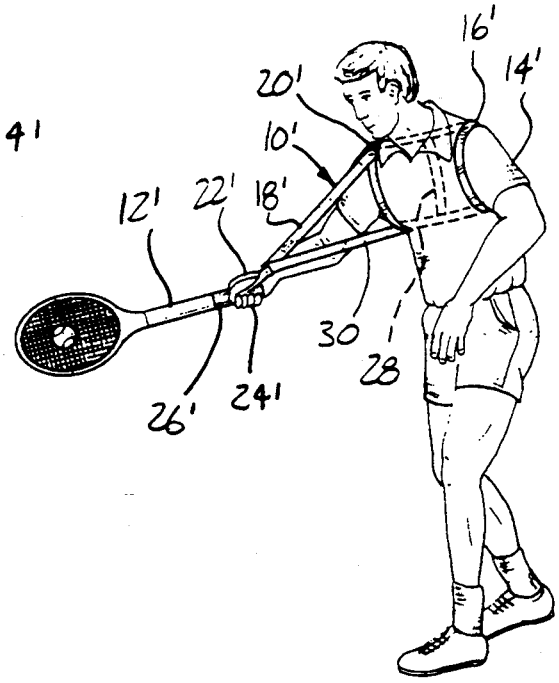
Figure 7:
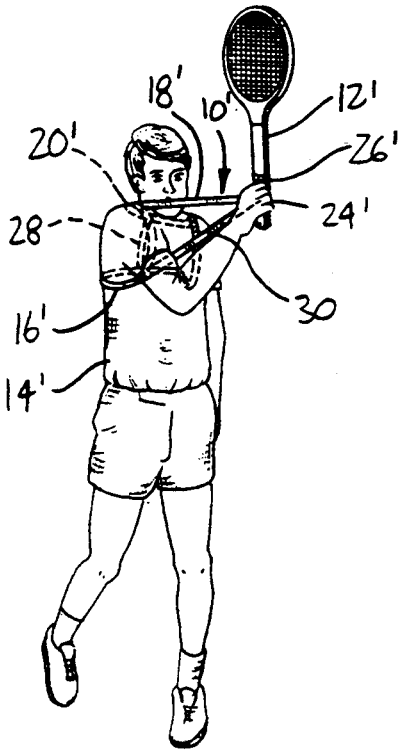

Turning to FIGS. 5–7, an alternative embodiment of the subject invention is generally shown at 10'. The loop 16' is large enough to extend over the whole back and around both shoulders of the trainee 14'. In order to maintain the proper distance between the top and bottom portions of the loop as they extend over the back of the trainee 14', a stay 28 fabricated from the same material as the loop 16' extends between the portion of the loop 16' extending over the shoulders and the portion of the loop 16' extending below the shoulders. Additionally, a second strap 30 extends from the loop 16' to the second end 22' of the strap 18'. The second strap 30 is also fabricated from the flexible inelastic material which is used for the rest of the sport swing harness 10, 10'. The second strap 30 increases the restraint on the motion of the trainee 14' as the trainee moves through the complete golf swing or tennis stroke.

Figure 8:
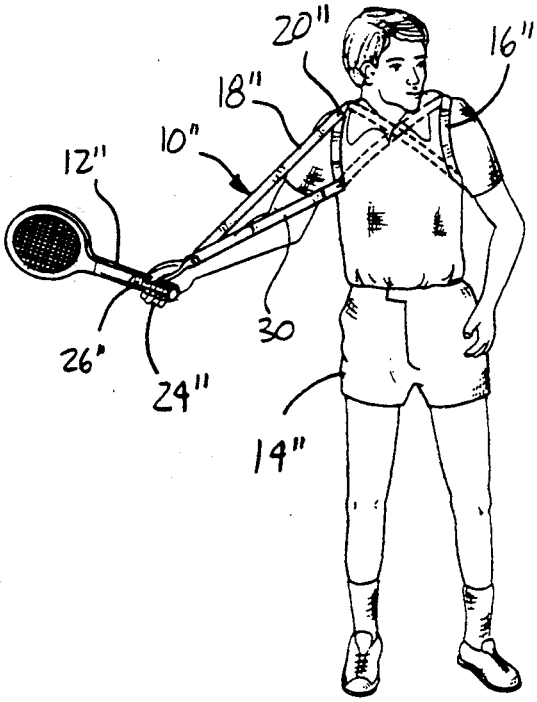
FIGS. 8–10 are various views of a trainee using a second alternative embodiment of the subject invention.
Figure 9:
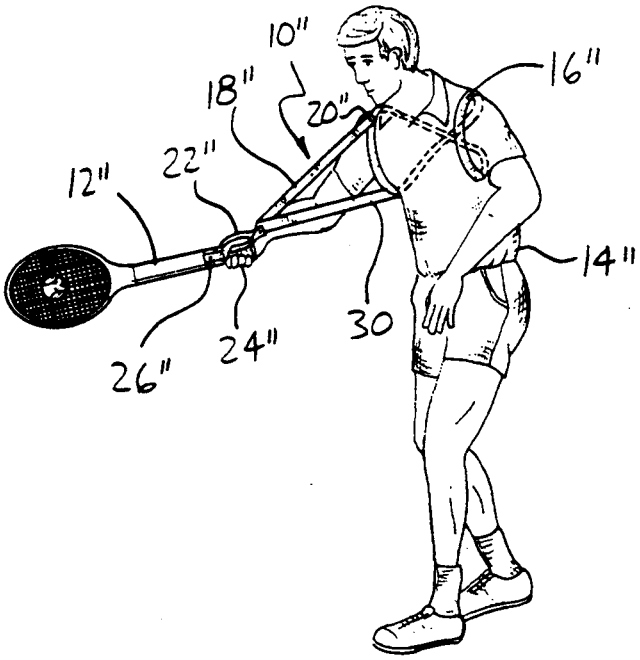
Figure 10:
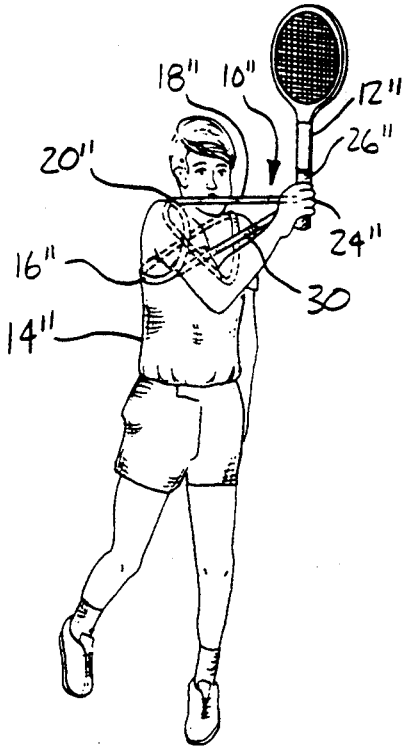
Figure 11:
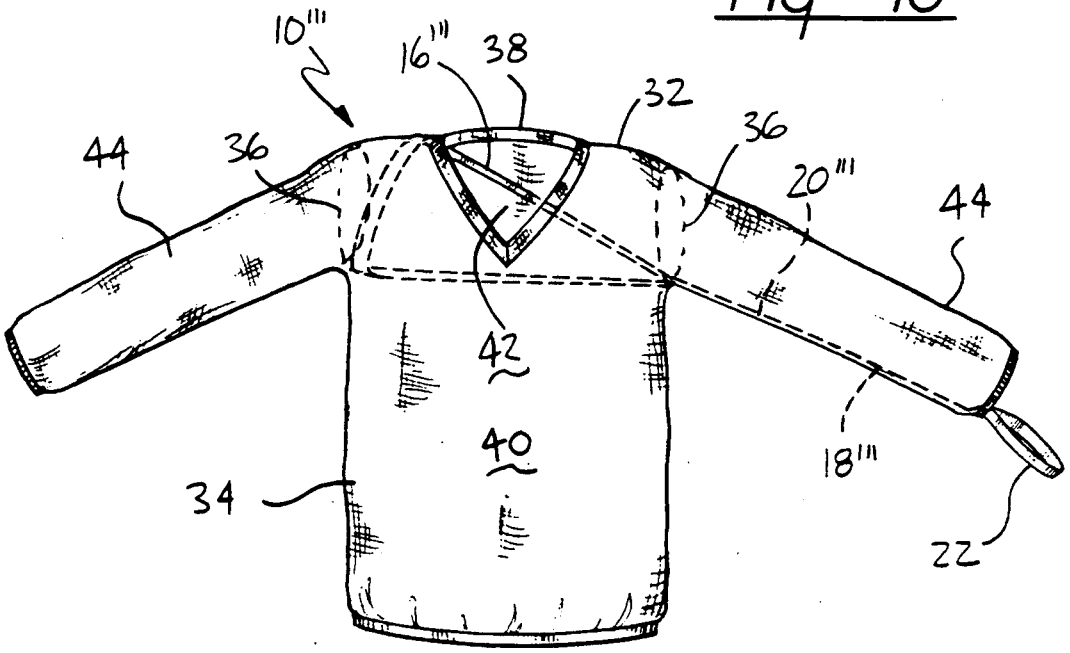
FIG. 11 is a third alternative embodiment of the subject invention.

Turning to FIGS. 8–10, a second alternative embodiment is generally shown at 10''. The second alternative embodiment 10'' is substantially similar to the first alternative embodiment 10' with the exception of the stay 28. The loop 16'' is folded over once to create a "figure 8" configuration. Because the "figure 8" configuration provides a support in the center of the back, the stay 28 is not needed.

FIG. 10 shows a third alternative embodiment of the subject invention 10'''. Although any one of the preferred embodiment, first alternative embodiment, or the second alternative embodiment may be used when describing the third alternative embodiment, the third alternative embodiment 10''' is shown incorporating the preferred embodiment 10 therein. More specifically, the preferred embodiment of the sport swing harness 10 is incorporated into a sport garment 32. The sport garment 32 covers the torso of the trainee 14 and may include any one of the following sports garments 32: a shirt; a sweater; a vest; or a jacket. In the Figure, the sports garment 32 is a sweater. The sweater 32 includes a body 34 provided with sleeves 44 having armholes 36, one for each arm of the trainee 14, a neck hole having a defined neckline 38 for having the head and neck of the trainee 14 pass therethrough wherein all of the arm holes 36, 36, and neckhole 38 of the garment are disposed between a front portion face 40 and back portion face 42 of the sport garment 32. A loop 16''' of flexible inelastic material is fixedly secured to the front portion 40 and back portion 42 faces circumscribing one of the two armholes 36. The strap 18''' having first end 20''' and second end 22''' is attached to the loop 16''' and fixedly secured to the back portion 42 of the sport garment 32. Depending on the style of the sport garment 32, the loop 16''' may be fixedly secured to the sleeve 44 associated with the leading hand 24 of the trainee 14. The second end 22''' of the strap 18''' extends out the sleeve 44 (if the sport garment 32 includes sleeves) wherein the leading hand 24 of the trainee 14 may grasp the second end 22''' as the strap 18''' extends out of the sleeve 44.

The method for using the sport swing harness 10 includes the steps of inserting at least one hand through a loop 16, extending a strap 18 over the back and under the shoulder of the other arm of a trainee 14; and grasping the second end 22 of the length 18 with the leading hand 24 of the trainee 14 wherein the trainee 14 may then swing a golf club or tennis racket pursuant to the restraints created by the sport swing harness 10 as created for the trainee 14.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. A sport swing harness (10'''') used with a sport swing implement (12'''') for increasing the consistency of a sport swing of a trainee (14) when hitting a ball through a trajectory, said sport swing harness (10'''') comprising:

a loop (16'''') of flexible inelastic material;

a length (18'''') fabricated from a flexible inelastic material having first (20'''') and second (22'''') ends and a substantially triangular face (19) extending therebetween, said first end (20) fixedly secured to said loop (16'''') such that said loop (16'''') receives a first shoulder of a trainee (14) therethrough and said length (18'''') extends over a back and underneath a second shoulder of the trainee (14) and said second end (22'''') is held by the trainee (14) with a handle (26'''') of a sport swinging implement (12'''') as the sport swinging implement (12'''') is rotated through a complete swing, said flexible inelastic material of said length (18'''') providing a total restraint of the swing wherein said triangular face (19) is aligned to be perpendicular to the ground.

2. A golf swing harness used with a golf club for increasing the consistency of a golf swing of a trainee, said golf swing harness comprising a closed loop of flexible inelastic material adapted to receive the trailing arm of said trainee and wrap around the shoulder thereof and extend along the back of the trainee in the form of a "V" having the apex thereof located at a point below the arm pit and below the other shoulder of the trainee, a strap fabricated from a flexible inelastic material having a first end and a second end, said first end of said strap fixedly secured to said loop at said apex thereof, and said second end of said strap being held by the leading hand of the trainee together with the handle of said golf club so as the golf club is rotated through a complete swing, said flexible inelastic material of said closed loop and said strap provides a total restraint of the swing to develop a consistent swing of the golf club.

3. The golf swing harness of claim 2 wherein said second end of said strap terminates with a loop of flexible inelastic material which is held by the hand of the leading arm of the trainee during the golf swing.

4. The golf swing harness of claim 3 wherein said harness forms an integral part of a garment which is adapted to be worn by the torso of said trainee and includes a body having a front portion and a back portion defining two armholes and a neck hole.

* * * * *